United States Patent [19]

Hewitt

[11] 4,351,293

[45] Sep. 28, 1982

[54] DIESEL VEHICLE SPEED CONTROL SYSTEM

[76] Inventor: John T. Hewitt, 129 Sheldon St., El Segundo, Calif. 90245

[21] Appl. No.: 45,140

[22] Filed: Jun. 4, 1979

[51] Int. Cl.[3] ..... F02D 1/04; F02B 77/08

[52] U.S. Cl. ..... 123/198 DB; 123/198 D; 123/379

[58] Field of Search ..... 123/140 FG, 140 ML, 123/198 DB, 102, 139 E, 140 R, 198 D, 379, 382, 383, 385, 386, 387, 388; 180/175, 176, 177

[56] References Cited

U.S. PATENT DOCUMENTS

| | | | |
|---|---|---|---|
| Re. 27,324 | 3/1972 | Granger | 180/176 |
| 2,147,390 | 2/1939 | Vaudet | 123/500 |
| 2,845,915 | 8/1958 | Frick | 123/140 R |
| 3,202,161 | 8/1965 | Richards | 123/198 D |
| 3,533,391 | 10/1970 | Lockmuller | 123/198 DB |
| 3,605,711 | 9/1971 | Fuso | 123/198 D |
| 3,699,935 | 10/1972 | Adler | 123/139 E |
| 4,023,549 | 5/1977 | Hewitt | 123/198 D |
| 4,126,084 | 11/1978 | Inada | 123/117 A |
| 4,129,040 | 12/1978 | Hayden | 123/198 D |
| 4,148,289 | 4/1979 | Hewitt | 123/140 MC |

FOREIGN PATENT DOCUMENTS

| | | | |
|---|---|---|---|
| 1437669 | 6/1976 | United Kingdom | 123/198 DB |

*Primary Examiner*—Charles J. Myhre
*Assistant Examiner*—Carl Stuart Miller
*Attorney, Agent, or Firm*—Fulwider, Patton, Rieber, Lee & Utecht

[57] ABSTRACT

There is disclosed a speed control system for a diesel-powered vehicle in which a sensing element responsive to the speed of the vehicle or engine, preferably responsive to the vehicle speed, is connected through control means to close the fuel supply to the diesel engine, thereby permitting a preset limitation on vehicle and/or engine speed. The control system is designed as a retrofit to existing diesel engines and utilizes conventional elements such as the shut down lever of these engines, thereby avoiding any significant engine alterations or modifications.

14 Claims, 10 Drawing Figures

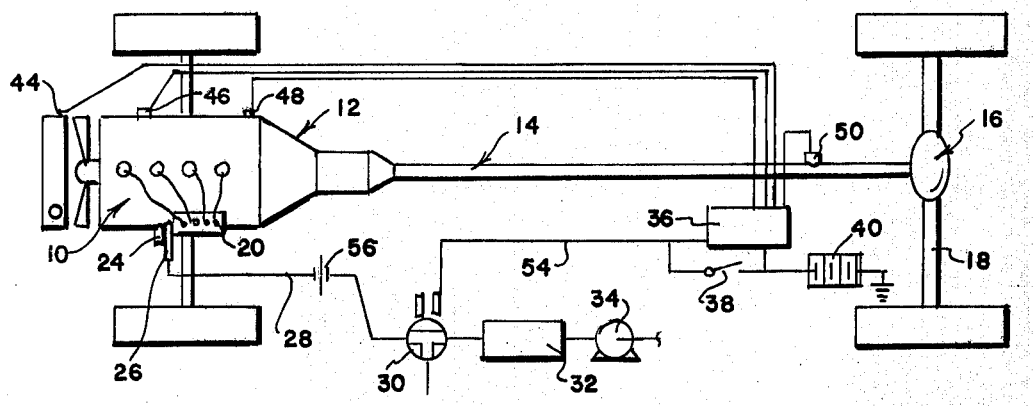
FIGURE 1
FIGURE 4
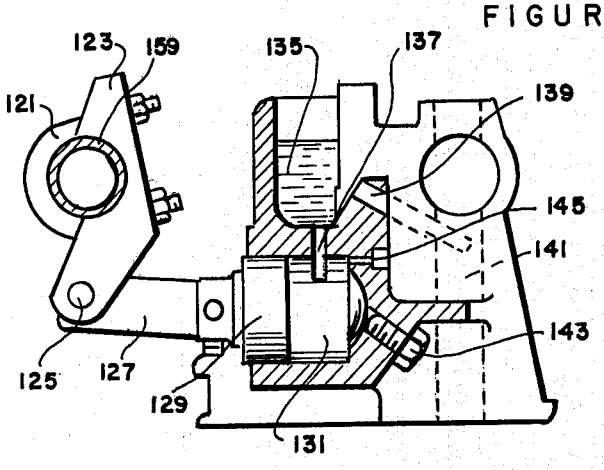
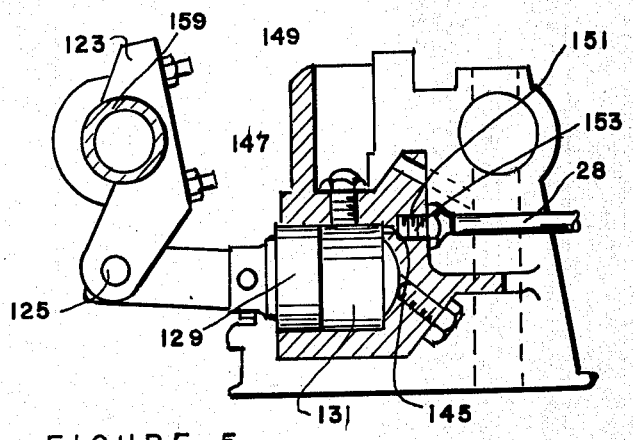
FIGURE 5

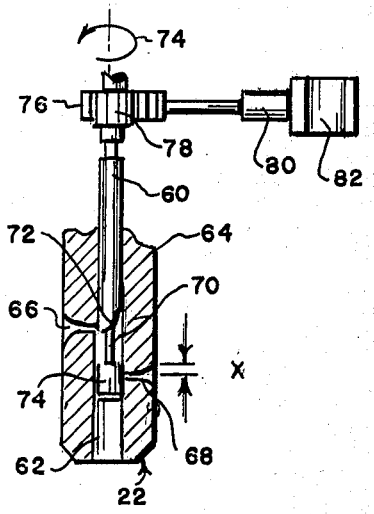
FIGURE 2
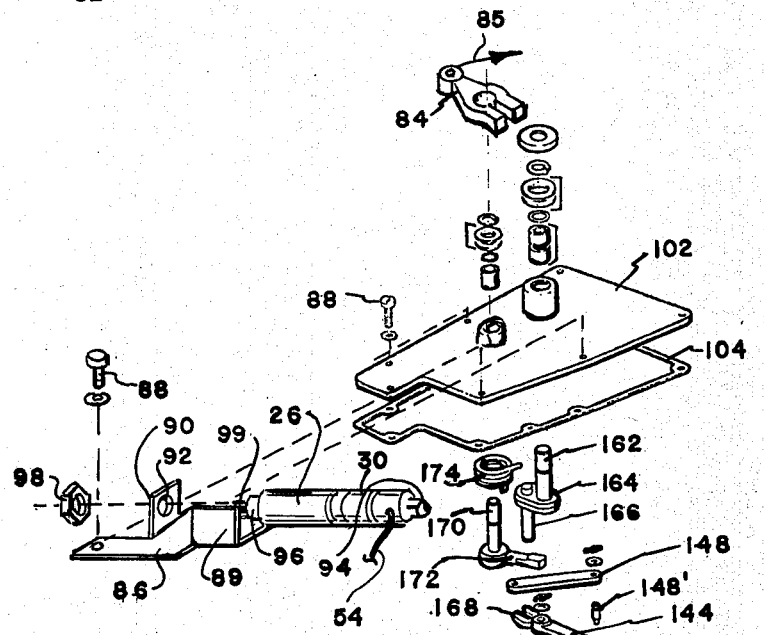
FIGURE 3
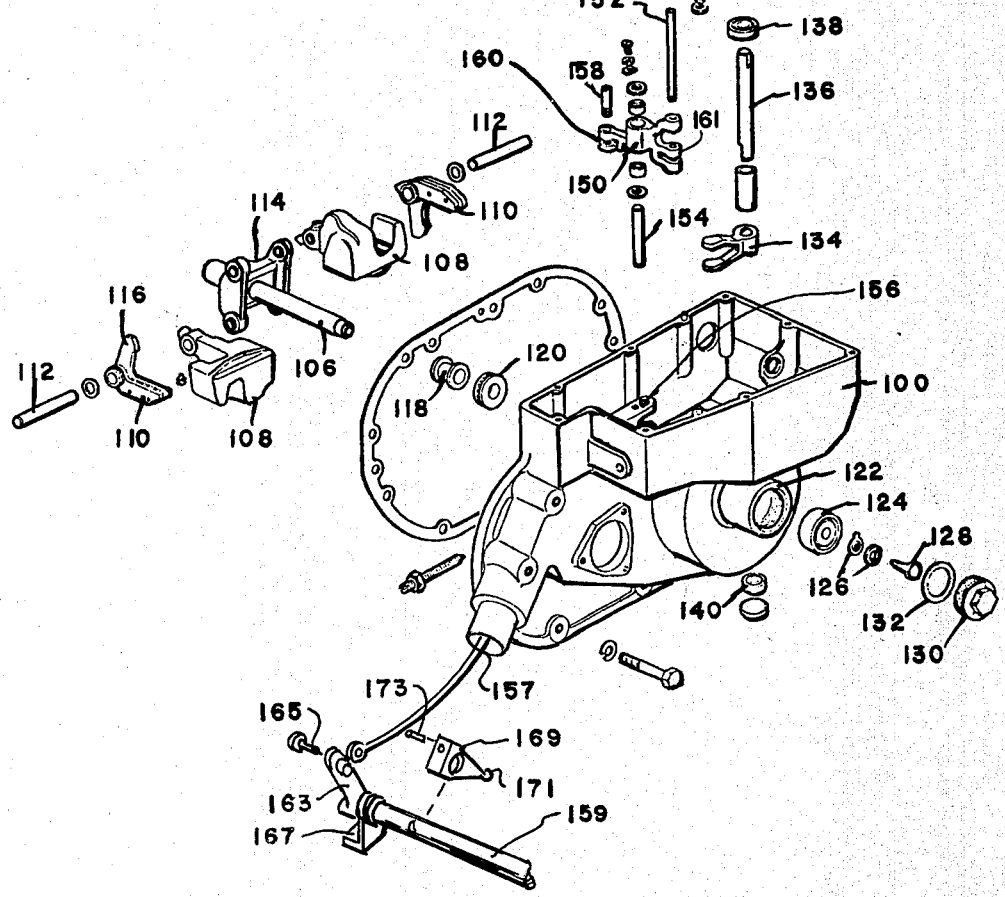

DIESEL VEHICLE SPEED CONTROL SYSTEM

BACKGROUND OF THE INVENTION

Diesel-powered vehicles such as the commercial tracks and the like are frequently operated in excess of the safe and/or optimum conditions of engine and vehicle speed. The resistance of the operators of these vehicles to comply with posted and accepted safe maximum speed limits will ultimately result in provision for an automatic, self-contained unit limiting vehicle speed. Such a control system is desirable not only for safety, but, also to prevent abuse of the vehicle and avoid premature engine and/or vehicle overhauls.

The problems and expenses of installation of such control systems becomes enormous if applied to the millions of trucks which are presently in service. Any system to be effective, therefore, must provide a very facile and inexpensive retrofitting of existing vehicles and, in particular, must not involve any substantial engine or vehicle modifications.

The typical diesel-powered vehicle is not a simple vehicle for installing a retrofit speed governing device since many of such vehicles have engine compression braking whereby the exhaust valves of the engine are opened during the power stroke of the engine in the fuel shut-off or shut down mode so that the engine functions as an air compressor. Accordingly, any attempted utilization of the shut down operation of the diesel engine for automatically responding to excessive vehicle and/or engine speed results in a very jerky and abrupt cycling of the vehicle, rendering the vehicle entirely unsuited for use.

BRIEF DESCRIPTION OF THE INVENTION

This invention comprises a simple retrofit system for adapting diesel-powered vehicles to a speed control responsive to engine and/or vehicle speed. Preferably, the system is responsive to vehicle speed and includes a speed sensing element responsive to speed of revolution of the drive shaft and/or an axle of the vehicle that generates a speed intelligent signal which is applied to a control unit and compared therein to a preset value corresponding to a maximum desirable engine and/or vehicle speed. If the sensed signal exceeds the preset value, the control means generates a control signal that is applied to a control valve located in a fluid pressure supply conduit communicating with a fluid pressure actuator which is operatively connected to the fuel control of the diesel engine. This invention includes a flow restrictor in the fluid supply conduit to the fluid pressure actuator which dampens the response of the actuator to the applied pressure, thereby avoiding abrupt surging of the engine and vehicle in response to the control means and permitting a smooth and effective governing action which does not otherwise interfere with normal vehicle operation.

BRIEF DESCRIPTION OF THE DRAWINGS

The invention will be described with reference to the figures of which:

FIG. 1 is a schematic of the control system as applied to a conventional diesel-power vehicle;

FIG. 2 illustrates a fuel injector of a conventional diesel engine;

FIG. 3 is an exploded view of a typical diesel engine governor system;

FIGS. 4 and 5 illustrate retrofitting this invention to a conventional throttle delay mechanism of a diesel engine;

DESCRIPTION OF PREFERRED EMBODIMENTS

Figure 6:
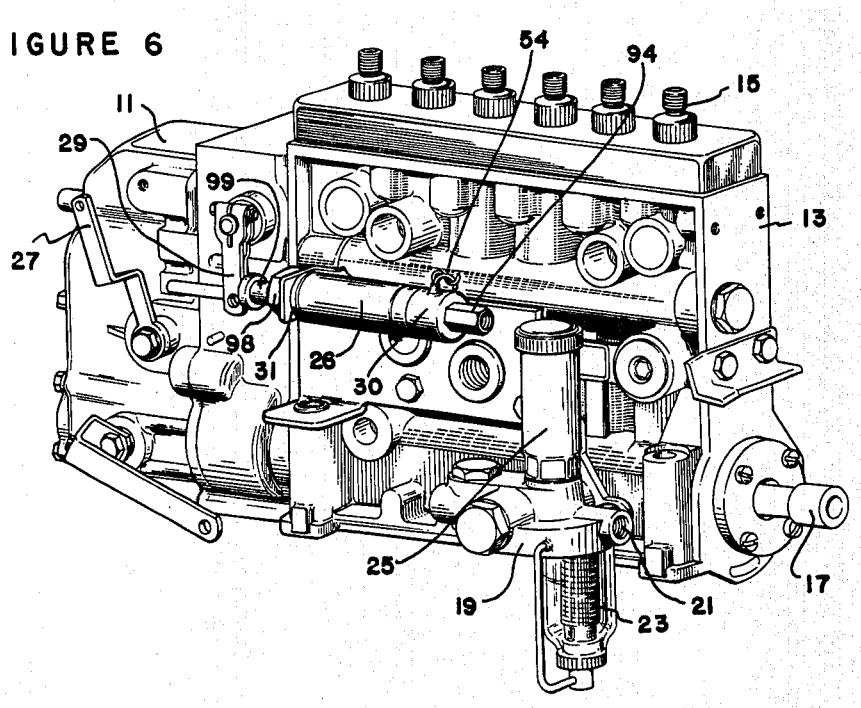
FIGS. 6 and 7 illustrate alternative installations.

Referring now to FIG. 1, the invention is adapted to a conventional diesel-powered vehicle having the illustrated operative components. The vehicle has a diesel engine 10 which drives a transmission located within bell housing 12 and has a drive shaft 14 extending to a differential 16 at the rear axle 18. The diesel engine 10 is commonly provided with a fuel injection pump 20 having fuel lines discharging to the cylinder injectors such as 22. Typically, the fuel pump 20 has a governor 24 which has throttle and shut down levers interconnected to manual and automatic control means of the vehicle.

The invention comprises the use of a fluid responsive means, such as actuator 26, that is mechanically interconnected to the shut down lever of the vehicle. The fluid responsive actuator 26 is connected through conduit 28 to a control valve 30 which is functional to supply a source of fluid pressure, typically air pressure from reservoir 32 that is maintained at a superatmospheric pressure by blower or pump 34. Typically, the control valve 30 is a three-way valve which can apply the pneumatic pressure to the actuator and/or exhaust the actuator to the atmosphere depending upon the setting of the valve.

Preferably, the control valve 30 is an electrical solenoid valve and is responsive to an electrical signal generated by the control means 36 and/or the manual shut down switch 38 which can apply the electrical voltage from storage battery 40 to the coil of the electrical solenoid valve 30.

Some of the diesel-powered vehicles have the aforementioned fluid actuator and fluid supply means. The control means of these vehicles frequently includes a sensor 44 that is responsive to the level of engine coolant, water and the like, or temperature of the coolant, element 46. Such control systems can often include a sensor 48 responsive to the pressure of the lubricating oil of the engine.

The aforementioned engines are adapted to speed control in accordance with the invention by positioning a speed responsive element 50 adjacent to and responsive to the rotational speed of the drive shaft 14 and/or rear axle 18 of the vehicle. The sensed signal generated by this sensing element 50 is applied to the control means 36 and compared therein to a preset electrical signal having a predetermined value whereby an excess value of the sensed signal generates a control signal that is applied through line 54 to the solenoid of the control valve 30.

Because the typical diesel-powered engine responds abruptly to actuation of the shut down lever, and because such abrupt response results in a very jerky operation of the vehicle, this invention also includes a flow restricting element 56 in the fluid supply conduit 28 to the fluid pressure actuator 24 of the engine. Preferably this flow restricting element has a predetermined flow restriction to dampen the response of the shut down mechanism and achieve a smooth vehicle operation. A suitable element is a plug formed of metal particles, e.g., bronze particles, that are sintered together to form a body of limited permeability. The permeability of the plug can be controlled to precise values by the sintering conditions so that an infinite variation of permeability is available for selection to fit the particular application. In a typical embodiment for the engine of FIG. 3, the permeability is selected to provide a cycle time of an actuator with a stroke of 1 inch from 4 to 5 seconds. Other restrictor elements can also be used, however, the permeable, sintered metal plugs are preferred.

Referring now to FIG. 2, the construction and operation of a typical fluid injector used on a commercial diesel engine will be described. The fuel injector 22 is a unit injector, one unit being employed for each of the cylinders of the engine. The fuel injector includes an injector plunger 60 that is reciprocally mounted in the through bore 62 of an injector housing 64. The housing has an inlet port 66 and a subjacent outlet port 68 communicating with through bore 62. The injector is mounted in the cylinder with its through bore 62 discharging into the cylinder and the inlet and outlet ports in communication with the fuel supply system.

The plunger 60 is reciprocated in a timed relationship to the engine by a follower, not illustrated, which is axially aligned with the plunger and which is reciprocated by rocker arms, cams and the like, of the engine. The plunger has a reduced diameter segment 70 with a helix shoulder 72 at its uppermost junction with the full diameter portion of the plunger and a lower, full diameter head 74. The effective stroke of the plunger is the distance X which is the vertical separation between the outlet port 68 and the top shoulder of head 74 of the plunger when the helix shoulder 72 just covers the inlet port 66. The movement of the plunger through distance X meters and pressures an exact quantity of fuel into the cylinder.

The rotation of plunger 60 will change the timing of the covering of the inlet port 66 with the helix shoulder 72 such that rotation in a counterclockwise direction as shown by arrowhead line 74 will provide covering of the inlet port 66 with shoulder 72 earlier in the stroke and thus increase the effective stroke length, distance X, and increase the fuel injected into the cylinder.

The rotation of the plunger 60 is effected by the rack 76 which engages a gear 78 which is coupled to plunger 60. The rack 76 is distally carried by the control rack 80 of the injector which has a U-shaped bracket 82 which is mechanically coupled to a fuel control arm that is mounted on a fuel tube of the fuel control system which is described in greater detail with reference to FIG. 3.

The control system of the invention is applied to a speed limiting mechanical governor such as commonly employed with a conventional two-cycle supercharged diesel engine. An exploded view of the limiting speed governor is shown in FIG. 3. This structure includes a governor housing 100 closed by a top coverplate 102 with a gasket 104. The centrifugal weight assembly of the governor is carried on shaft 106 and includes a pair of low speed weights 108 and a pair of high speed weights 110 which are pivotally mounted by weight pins 112 on a carrier bracket 114 that is secured to shaft 106. Arms 116 of high speed weights 110 bear against a riser bushing 118 that is slidably mounted on shaft 106 together with a thrust bearing 120. Shaft 106 is received in journal 122 with a thrust bearing 124 and lock washers 126 and retainer bolt 128. The assembly is sealed by plug 130 and gasket 132. The riser thrust bearing 120 bears against fork 134 which is secured to the throttle operating shaft 136, the latter shaft being mounted in a bracket (not shown) carried on the inside sidewall of the housing 100. Bearings 138 and 140 are seated in the upper and lower brackets, respectively, to rotatably support operating shaft 136. The upper end of operating shaft 136 carries lever 142 to which is pivotally connected differential lever 144 by pin 146. Link 148 extends into pinned connection to the operating control link being secured to the upper end of pin 152. The operating control link 150 is pivotally supported by pin 154 which is mounted in bracket 156 of housing 100. The fuel control rod 157 is secured to the operating control link 150 by pin 158 that extends into the fork end 160 of this member.

The governor is connected to the fuel control system of the engine through the fuel control rods such as 157. In the particular application, the governor is illustrated for a V-8 diesel engine and the fuel rods 157 extend to opposite sides of the engine with each rod coupled to a control tube 159 to control the fuel injected in each of a bank of four cylinders. The control rod 157 is coupled to control tube 159 through a control lever 163 having a fork end which receives pin 165. The control tube is rotatably mounted by brackets 167 at its opposite ends and carries four rack levers 169. Each rack lever has a finger 171 which is received in a respective U-shaped bracket 82 (see FIG. 2). Each rack lever 171 is mounted on its respective control tube 159 and secured thereto by a pin 173 which engages in a peripheral slot 175 of the control tube. The rack levers are resiliently mounted to the respective control tubes with torsion springs, not shown.

The throttle control linkage is secured to shaft 162 carried on crank 164 and has a dependent pin 166 which is received in the fork end 168 of the differential level 144 thereby providing mechanical linkage from the throttle control to the fuel control rack of the engine.

The stop lever of the mechanism which is utilized in the application of this invention is shown as lever 84 which is carried on the upper end of shaft 170 that also carries arm 172. Arm 172 bears against the upper end of connecting pin 152 whereby movement of lever 84 in the direction shown by the arrowhead line 85 will cause a corresponding rotational movement of the operating control link 150 and effect a proportional rotation of the fuel rods such as 157 to decrease the fuel supply to the engine. Resilient means in the form of a torsion spring 174 is mounted on shaft 170 to urge the lever 84 in a direction opposite that of the arrowhead line.

The fluid responsive actuator 26 for the shut down lever 84 is commercially available for mounting on the governor housing 100 with a bracket 86 which is secured to the governing housing by machine screws 88. The bracket 86 has an upright side flange 89 and an upright end flange 90 having a central aperture 92. The actuator 26 comprises a conventional piston and cylinder actuator having an inlet port 94 to which conduit 28 (FIG. 1) is secured. The actuator 26 is mounted on the bracket 86 by inserting the threaded neck 96 of the actuator 26 into aperture 92 and retaining it with nut 98. The piston rod 99 of the actuator 26 is mechanically linked to the shut down lever 84 of the governor assembly. This mechanical link can simply comprise a rounded head such as an acorn nut carried on the end of rod 99 that bears against the end of the shut down lever 84. The actuator assembly 26 bears internal resilient means such as a helical compression spring which is biased to urge retraction of the piston rod 99 and the shut down lever 84 is similarly biased by resilient means in the governor structure. The actuator 26 shown in FIG. 3, distally carries the control valve 30 (FIG. 1) and electrical lead 54 is connected to the terminal of the solenoid coil of the valve and extends to the control system 36 of the invention.

The invention is readily adaptable to the conventional diesel engines without any significant structural modifications. The invention is employed in the system by the use of the fluid responsive actuator 26 and the installation of a vehicle speed transducer 50 to generate a vehicle speed intelligent signal to the control means 36. In some instances, the conventional vehicle speed transducer used with the vehicle's speedometer can be used directly, thus even further simplifying the installation.

Referring now to FIGS. 4 and 5, another embodiment of the invention will be described. FIG. 4 illustrates a conventional acceleration delay mechanism that is present in diesel engines. The particularly illustrated one is mounted on the cylinder heads and is commonly found between the number 1 and number 2 cylinders on the right bank cylinder head. The assembly is mechanically coupled to the control tube 159 by U-bolt 121 that is secured to the acceleration delay lever 123. The latter is coupled to link arm 127 by pin 125. Link arm 127 extends to a connection to piston 129 that is mounted in cylindrical bore 131. The cylindrical bore 131 is in casting 133 which has an oil reservoir 135 with a through bore 137 which communicates with the cylindrical bore 131 to supply oil thereto from reservoir 135. The reservoir 135 receives oil through fitting 139 which communicates with bore 141. A check valve 143 is provided in the assembly.

The acceleration delay mechanism functions by dampening the rotational movement of the control tube 159. When the control tube is moved to rotate the injector racks towards the fuel shut-off position, the retraction of piston 129 draws air into cylindrical well 131 through check valve 143. When piston 129 uncovers the oil drain 137, the oil from reservoir 135 fills the cylindrical bore 131. Depressing the throttle for acceleration of the engine causes piston 129 to advance into cylindrical well 131. This movement of the piston is retarded by displacement of the oil from the cylindrical well through the small diameter, calibrated orifice 145.

The aforedescribed mechanism is retrofitted for the installation of the invention by tapping a threaded aperture 147 in the drain aperture 137 and fitting the tapped aperture 147 with a sealing plug 149. The counterbore 151 of the delay orifice 145 is also tapped and receives a threaded fluid pressure insert fitting 153. Fitting 153 sealingly secures the fluid supply conduit 28 to this orifice, thereby converting the dampening piston 129 and cylindrical bore 131 into a fluid responsive actuator which can effect the control of the diesel engine in response to the sensed parameters previously described.

Referring now to FIG. 6, there is illustrated a governor 11 and fuel injection pump 13 used for a conventional diesel engine. The injection pump 13 has a plurality of fuel delivery fittings 15, one for each of the cylinders of the engine and a cam shaft 17 which is driven by the engine and which drives the reciprocating pistons of the pump 13. The assembly also includes the fuel supply pump 19 with a fuel intake threaded fitting 21 and a preliminary fuel filter 23. This pump also includes a hand primer pump 25 for manual priming of the fuel supply pump.

The governor 11 has control lever 27 which is mechanically connected to the throttle linkage for effecting movement of the rack (not shown) within injection pump 13. The shut-off lever 29 is also connected for movement of the rack to the shutdown position of the engine. The invention is applied to this pump and governor assembly by mounting of the actuator 26 to the pump housing with bracket 31 having a central aperture which receives a threaded neck of the actuator 26 and which is secured by nut 98. The outboard end of piston rod 99 bears against the shutdown lever 29 of the governor housing. The actuator 26 also includes the solenoid control valve 30 with the connecting leads 54 that receives a pressured fluid such as hydraulic fluid or air by a conduit which is connected to the threaded inlet port 94.

Figure 7:
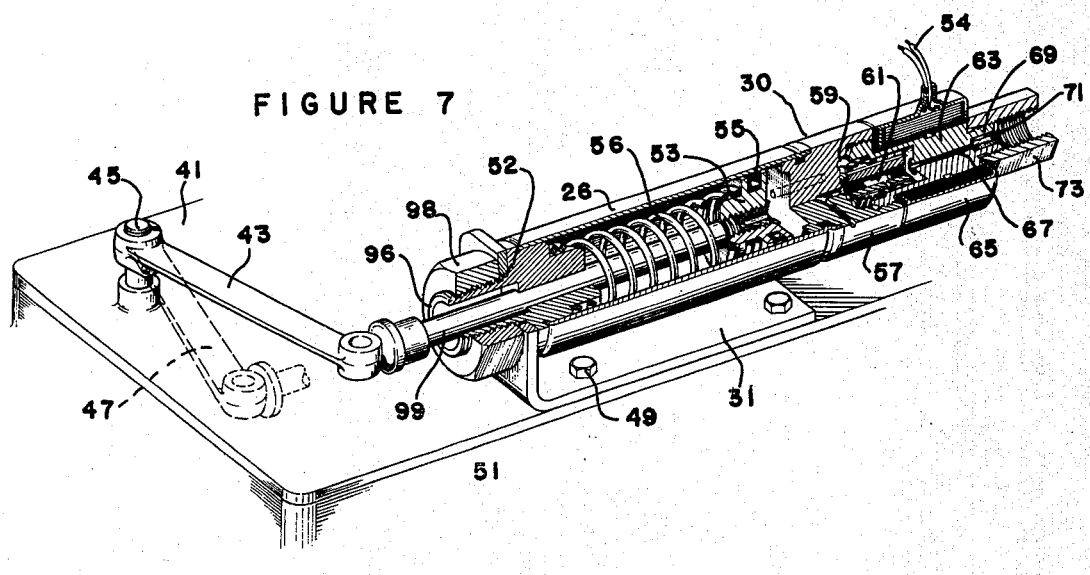

FIG. 7 illustrates another application of the actuator to a diesel engine governor. The governor housing has a cover plate 41 with a shutdown lever 43 which is coupled through shaft 45 to the rack of the fuel injection pump in a manner permitting displacement of the rack with pivotal movement of lever 43 whereby movement of lever 43 to the position 47 will effect complete displacement of the rack and shutdown of the engine. The actuator 26 is mounted to cover plate 41 of the governor by bracket 31 with machine bolts 49. The upright flange 51 of bracket 31 has a central aperture 52 which receives the threaded neck 96 of the actuator. The assembly is secured by nut 98 which is threadably secured to neck 96. The piston rod 99 of actuator 26 projects against the shutdown lever 43 that is resiliently biased against the end of piston rod 99 by springs carried internally of the governor. Slidably mounted within the cylinder of actuator 26 is piston 53 which has a peripheral groove for O-ring 55. The control valve 30 has a cylindrical housing 57 that is permanently seated in the outboard end of the cylinder of actuator 26. This housing has a central valve seat 59 against which the reciprocal armature valve member 61 is seated. The valve housing is completed by the upper cylindrical member 63 which is threadably secured to the lower housing member 57. The electrical windings 65 of the solenoid are mounted about this member 63. Member 63 has a small diameter throughbore 67 which is counterbored at 69 to receive a sintered metal plug 71 which has a closely controlled flow area for the hydraulic fluid whereby the restrictor member provides a predetermined delay in operation of the actuator, typically providing a four to five second time delay for effecting movement of piston 53 through a one inch stroke. The outer face of upper member 63 has a central cylindrical boss which bears external threads for receiving threaded union member 73 for attachment of a conduit supplying hydraulic fluid.

Figure 8:
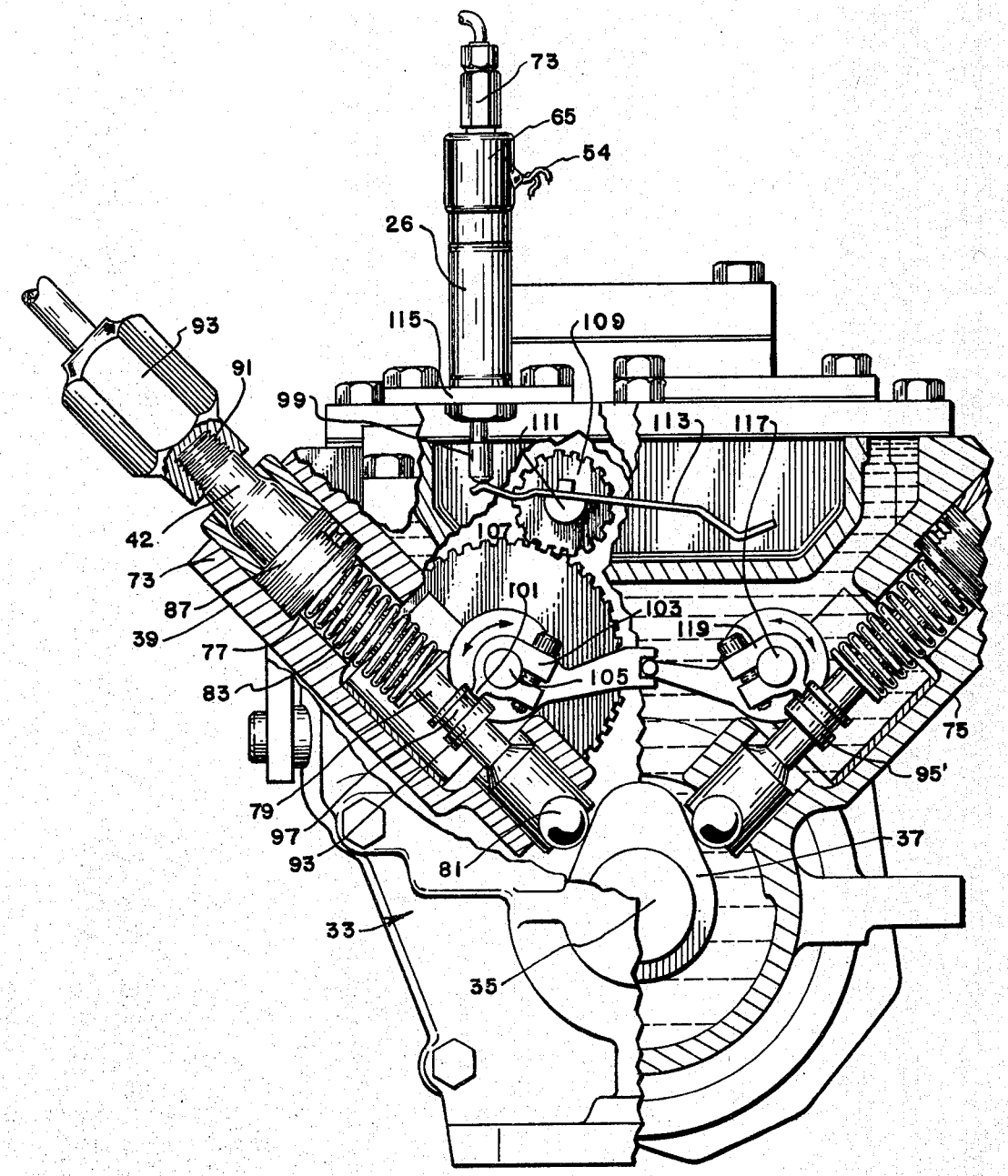
FIGS. 8–10 illustrate another alternative installation.

Referring now to FIG. 8, there is illustrated a sectional view of a fuel injection system of a conventional diesel engine which is retrofitted with the actuator of the invention. The injection fuel pump 33 of this system has a housing supporting a rotatable shaft 35 which is driven by the engine and which has a plurality of cams 37. A plurality of individual pumps 39 are located in two banks 73 and 75, the number corresponding to the number of cylinders of the diesel engine. Each individual pump 39 comprises a cylinder 77 with a reciprocating plunger 79 which bears a distal cam follower 81 in the form of a spherical bearing which is biased against the cam 37 by a helical compression spring 83. Each plunger is slidably received in a pump sleeve 87 and an adaptor sleeve 42 which has a threaded neck 91 for the attachment of the nut 93 of a conduit which extends to the injector of the respective cylinder.

Each injection pump plunger 79 slidably supports a metering sleeve 95 which has an annular groove 97 which receives a finger 101 of control fork 103 which is mounted on rotatable shaft 105. Shaft 105 also carries a timing gear 107 which meshes with gear 109 that is carried on shaft 111 which also carries lever 113. One end of lever 113 is beneath bracket 115 which supports the actuator 26 used in the invention. The actuator rod 99 extends into abutment against the end of lever 113 such that extension and retraction of the actuator rod 99 causes corresponding rotation of shaft 111 and of timing gear 107 whereby sleeve 95 can be fixedly adjusted in its position on plunger rod 79.

The fuel control system also includes a rotatable control tube 117 with a corresponding control 119 for the positioning of the sleeves 95 of the opposite bank 75 of individual fuel injector pumps.

Figure 9:
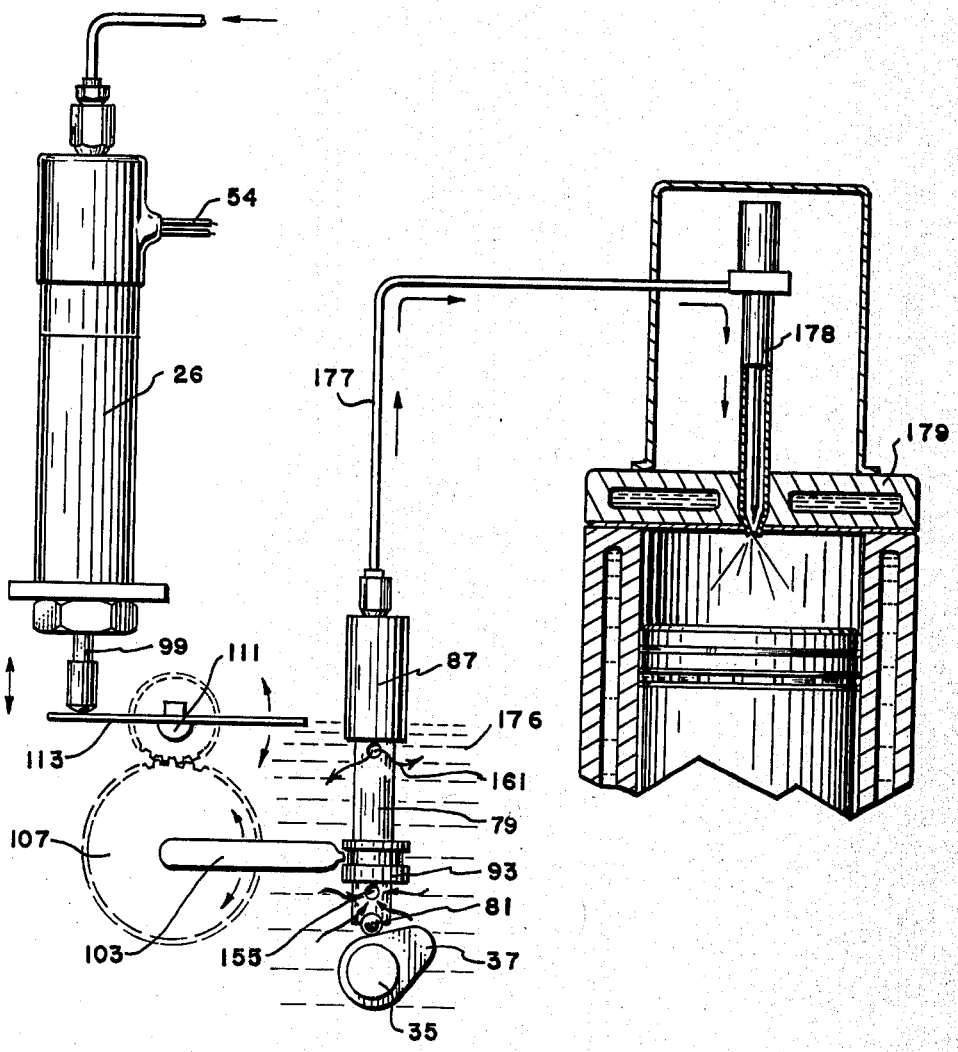

The operation of the injector pumps will be explained with reference to FIG. 9 which is a simplified illustration of the control system of FIG. 8. As there illustrated, actuator 26 is positioned with the actuator rod 99 bearing against lever 113 carried on shaft 111 and mechanically linked to the timing gear 107 having the control fork 103 that slidably adjusts the up and down position of sleeve 95. The cam follower 81 rides on cam 37 carried on shaft 35, raising and lowering the injection pump plunger 79 within the end fitting 87. The plunger 79 is hollow with a closed lower end and has a lower spill port 155 and an upper fill port 161. These ports serve to permit the surrounding fuel 176 to enter the hollow center of the plunger 79. When the plunger 79 is moved upwardly by cam 37, the fill port 161 is covered by the end fitting 87 and the spill port 155 is covered by sleeve 95. When these ports are covered, the continued upward movement of plunger 79 compresses the fuel and forces it through conduit 177 to the injector 178 of cylinder 179 of the engine. From the structure, it can be seen that displacement of sleeve 95 downwardly to cover the spill port 155 earlier in the travel of plunger 79 will seal this port and permit delivery of a greater quantity of pressured fuel to injector 178, whereas the raising of sleeve 93 to maintain port 155 uncovered during a longer period, will reduce the quantity of fuel so injected. Accordingly, the extension of rod 99 of actuator 26 of the invention will cause rotation of timing gear 107 in a counterclockwise direction as illustrated, raising the sleeve 93 and maintaining port 155 uncovered for a longer period of travel of the plunger 79, decreasing the fuel delivered to injector.

Figure 10:
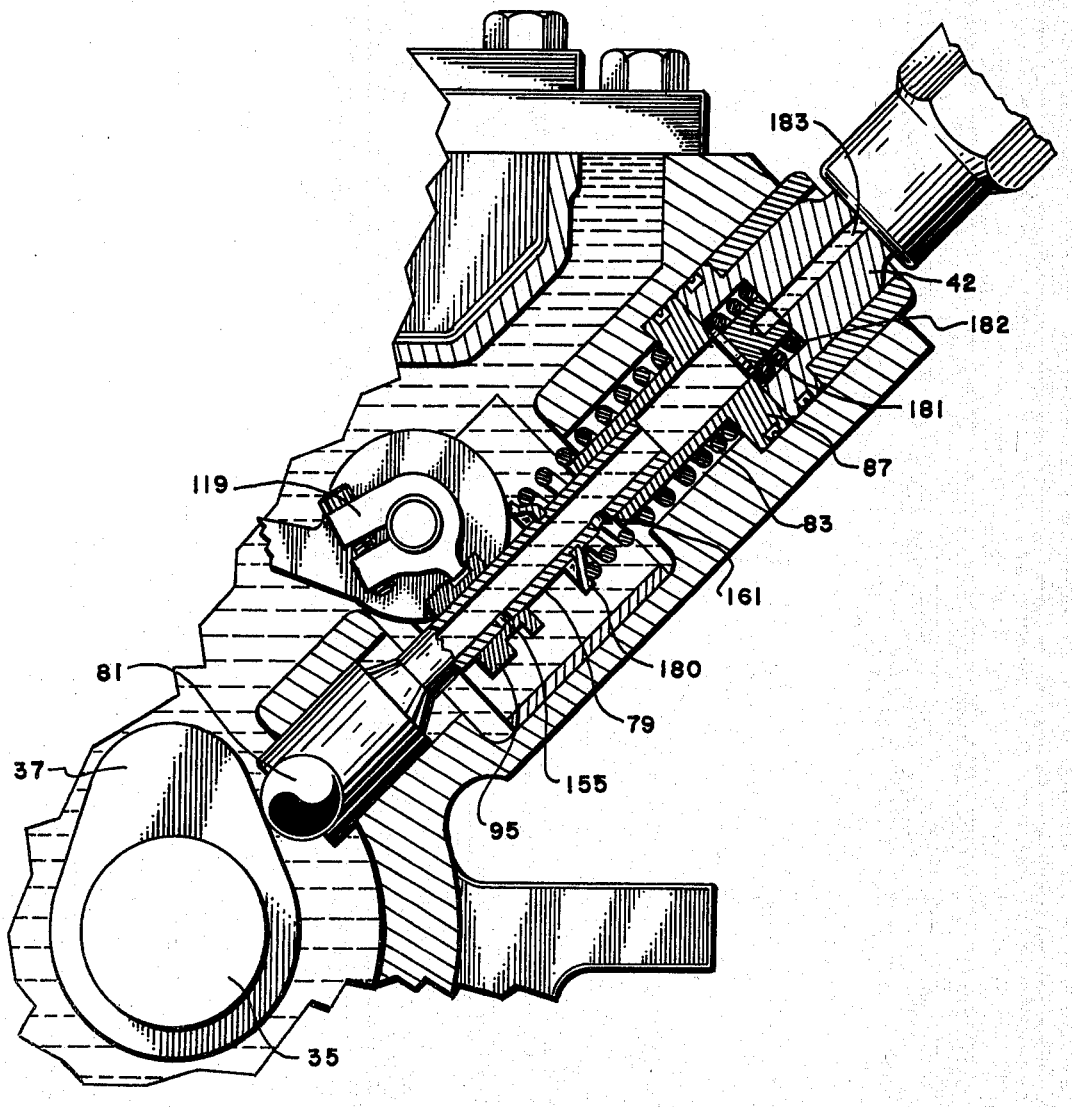

The actual structure of the individual fuel injection pumps is shown in greater detail in FIG. 10. As there illustrated, the sleeve 93 is shown on the pump plunger 79 having the lower spill port 155 and upper fuel fill port 161. The plunger 79 also has a spring retainer 180 which captures the helical coil spring 83 to bias the plunger and cam follower 81 against cam 37. The pressured fuel is delivered through a pressure regulator valve 181 having a helical coil compression spring 182 to permit lifting of the valve at a predetermined pressure within the injection pump. The fuel is discharged into the central through passageway 183 of fitting adapter sleeve 42.

The aforedescribed system commonly employs a hydraulic actuator or electrical solenoid mounted in the position in which the actuator 26 of the invention is illustrated. These actuators effect a full displacement, sufficient to shut down the engine in an undampened, on-off operation. The direct use of such actuators in the speed control system of this invention would result in an abrupt and jerky response of the engine, particularly in engines which are provided with air compression braking. The use of the actuator of this invention with its internal flow dampening restrictor, however, provides a controlled and predetermined time delay in the complete travel of the actuator rod 99 and effects a smooth and controlled deacceleration and shutdown of the engine when activated by the control means 36. As shown in FIG. 8, actuator 26 can be mounted on either side of the shaft 111 to operate on either end of lever 113; positioning the actuator to the right, above the longer arm of lever 113 will provide a slower response and require a greater displacement of actuator rod 99 to effect a complete shutdown of the engine then when the actuator is located in the illustrated position.

The invention has been described with reference to the illustrated and presently preferred embodiment. It is not intended that the invention by unduly limited by this disclosure of the presently preferred embodiment. Instead, the invention is intended to be defined by the means, and their obvious equivalents, set forth in the following claims.

What is claimed is:

1. In a vehicle having a diesel engine having multiple cylinders and fuel supply means including multiple metering valves and injectors, one set for each of said cylinders, fuel control means mechanically coupled to all said metering valves to control the volume of fuel delivered therefrom to said injectors, the improvement which comprises:

a fluid pressure responsive actuator having a variably positionable actuator arm engageable with said fuel control means to effect movement thereof in a fuel limiting direction, said arm being movable in said fuel limiting direction in response to fluid pressure applied to said actuator, said actuator including bias means for biasing said arm for travel in an opposite, non-fuel limiting direction upon removal of fluid pressure from said actuator;

pneumatic pressure fluid supply means including a source of air under superatmospheric pressure;

conduit means connecting said fluid supply means and said actuator, and including solenoid valve means having an open position for applying said air to said actuator, and a closed position for venting air from said actuator to atmosphere;

a speed sensing element responsive to one of vehicle or engine speed to generate a sensed signal responsive to sensed speed;

system control means to receive said sensed signal, compare said signal to a preset signal level corresponding to a maximum permissible speed, and generate an electrical control signal when said sensed signal deviates from said preset signal level;

means interconnecting said system control means to said valve means to actuate said valve means between said open and closed positions, according to the character of said electrical control signal; and air pressure restrictor means interposed between said pressure fluid supply means and said actuator, in the path of air applied to said actuator, to impede air flow to said actuator to slow extension of said arm in said fuel limiting direction, whereby said fuel is gradually restricted, permitting the speed of said vehicle to react to said reduced fuel flow during travel of said arm in said fuel limiting direction, and said restrictor means being out of the path of air venting to atmosphere from said actuator, whereby said arm is enabled to move relatively rapidly under the bias of said bias means in said non-fuel limiting direction, said restrictor means comprising a porous plug of limited permeability.

2. In a vehicle having a diesel engine having multiple cylinders and fuel supply means including multiple metering valves and injectors, one set for each of said cylinders, control means mechanically coupled to all said metering valves to control the volume of fuel delivered therefrom to said injectors, the improvement which comprises:

(a) fluid pressure responsive actuator means having an actuator arm mechanically linked to said control means to effect movement thereof in a fuel limiting direction;

(b) pneumatic pressure fluid supply means including a source of air under superatmospheric pressure;

conduit means connecting said fluid supply means and said actuator means, and including solenoid valve means having an open position for applying said air to said actuator means, and a closed position for exhausting air from said actuator means to atmosphere, (c) a speed sensing element responsive to one of vehicle or engine speed to generate a sensed signal responsive to sensed speed;

(d) control means to receive said sensed signal, compare said signal to a preset signal level corresponding to a maximum permissible speed and to generate an electrical control signal therefrom when said sensed signal deviates from said preset signal level;

(e) means interconnecting said control means to said valve means to actuate said valve means in response to said electrical control signal, and to develop pneumatic pressure in or vent pneumatic pressure from said actuator means, according to the character of said electrical control signal; and (f) air pressure restrictor means in said pressure fluid supply means in the path of air applied to said actuator means to regulate flow of said air to said actuator means and dampen the response of said actuator means, said restrictor means comprising a porous plug of limited permeability and being out of the path of air exhausted from said actuator means whereby the flow of exhausting air is unimpeded to atmosphere.

3. The vehicle of claim 2 wherein said control means includes a rack coupled to said metering valves.

4. The vehicle of claim 3 wherein said engine includes a shut down lever moveably mounted and mechanically coupled to said rack, and shutdown lever actuation means coupled to said lever to effect sufficient movement of said lever to reposition said rack to a shut down position closing said metering valves to cease delivery of fuel therefrom and wherein said fluid pressure responsive actuator means is positioned to mechanically link its actuator arm to said shutdown lever.

5. The vehicle of claim 2 wherein said restrictor means comprises a sintered metal plug.

6. The vehicle of claim 5 wherein said actuator means comprises a cylinder and reciprocating piston with an inlet fitting having a through bore communicating with said pressure fluid supply means and said sintered metal plug is seated in said through bore.

7. The vehicle of claim 5 wherein said speed sensing element is responsive to vehicle speed.

8. The vehicle of claim 7 wherein said speed sensing unit is mounted adjacent to and senses the rotational speed of the driveshaft of said vehicle.

9. The vehicle of claim 2 wherein said solenoid valve is mounted on said actuator cylinder and positioned in the through bore of said inlet fitting.

10. The vehicle of claim 2 wherein said vehicle also includes manual shut down means to apply a control signal to said control valve.

11. The vehicle of claim 7 wherein said vehicle also includes sensing means responsive to any or all of engine conditions of coolant temperature and level and lubricating oil pressure and said control means is operatively connected to generate a control signal when any of said sensed engine conditions changes from a preset safe valve to a hazardous valve.

12. The vehicle of claim 2 wherein said speed sensing unit is mounted on said engine adjacent to and operatively responsive to the rotational speed of one of the engine camshaft and crankshaft.

13. The vehicle of claim 2 wherein said metering valve comprises a reciprocating hollow metering plunger with an inlet port and a sleeve slidably received over said plunger and said control means comprises fork means to adjustably position said sleeve over said inlet port.

14. The vehicle of claim 13 wherein said control means includes shut down lever means mechanically coupled to said fork means and wherein said actuator means is positioned to mechanically link to actuator arm to said shut down lever means.

* * * * *

UNITED STATES PATENT AND TRADEMARK OFFICE

CERTIFICATE OF CORRECTION

PATENT NO. : 4,351,293

DATED : September 28, 1982

INVENTOR(S) : John T. Hewitt

It is certified that error appears in the above-identified patent and that said Letters Patent are hereby corrected as shown below:

Column 1, line 6, please delete "tracks" and insert --trucks--;

Column 4, line 33, please delete "level" and insert --lever--;

Column 6, line 43, please delete "throughbore" and insert --through bore--;

Column 8, line 17, please delete "then" and insert --than--;

Column 8, line 21, please delete "by" (first occurrence) and insert --be--; and

Column 10, line 36, please delete "valve" (both occurrences) and insert --value--.

Signed and Sealed this

*Twenty-seventh* Day of *December 1983*

[SEAL]

*Attest:*

GERALD J. MOSSINGHOFF

*Attesting Officer*

*Commissioner of Patents and Trademarks*